US009217608B2

(12) United States Patent
Krantz et al.

(10) Patent No.: US 9,217,608 B2
(45) Date of Patent: Dec. 22, 2015

(54) HEAT EXCHANGER

(75) Inventors: Joakim Krantz, Kristianstad (SE); Magnus Svensson, Lund (SE)

(73) Assignee: ALFA LAVAL CORPORATE AB, Lund (SE)

( * ) Notice: Subject to any disclaimer, the term of this patent is extended or adjusted under 35 U.S.C. 154(b) by 1272 days.

(21) Appl. No.: 12/747,585

(22) PCT Filed: Dec. 18, 2008

(86) PCT No.: PCT/EP2008/067854
§ 371 (c)(1),
(2), (4) Date: Jul. 13, 2010

(87) PCT Pub. No.: WO2009/080692
PCT Pub. Date: Jul. 2, 2009

(65) Prior Publication Data

US 2010/0276125 A1 Nov. 4, 2010

(30) Foreign Application Priority Data

Dec. 21, 2007 (SE) ..... 0702871

(51) Int. Cl.
*F28F 3/10* (2006.01)

(52) U.S. Cl.
CPC ..... *F28F 3/10* (2013.01)

(58) Field of Classification Search
CPC ..... F28D 9/0031; F28D 9/0037; F28D 9/005; F28D 9/0043; F28F 3/083; F28F 3/086; F28F 3/10
USPC ..... 165/167
See application file for complete search history.

(56) References Cited

U.S. PATENT DOCUMENTS

| | | | | | |
|---|---|---|---|---|---|
| 2,075,236 | A | * | 3/1937 | Seligman et al. | 165/167 |
| 2,217,567 | A | * | 10/1940 | Seligman et al. | 165/167 |
| 2,281,754 | A | * | 5/1942 | Dalzell | 165/167 |
| 2,619,329 | A | * | 11/1952 | Newhall | 165/167 |
| 2,699,324 | A | * | 1/1955 | Goodman | 165/167 |
| 2,865,613 | A | | 12/1958 | Egenwall et al. | |

(Continued)

FOREIGN PATENT DOCUMENTS

| | | |
|---|---|---|
| DE | 25 52 335 | 6/1977 |
| EP | 0 526 679 | 2/1993 |

(Continued)

OTHER PUBLICATIONS

Communication for Russian application No. 2010130536 (the Decision of Grant of Sep. 23, 2011).

(Continued)

*Primary Examiner* — Leonard R Leo
(74) *Attorney, Agent, or Firm* — Buchanan Ingersoll & Rooney PC

(57) ABSTRACT

A diagonal gasket support (22) in a heat exchanger cassette adapted for a heat exchanger having a contact-free flow channel (28), where the cassette (11, 29) comprises two plates (12) of the same type, where each plate is provided with a corrugated pattern having a plurality of ridges (19) and valleys (20), characterized in that the diagonal gasket support (22) comprises a plurality of indentations (23) and protrusions (24) positioned adjacent each other along a diagonal gasket groove (21). The advantage of such a diagonal gasket support is that a contact-free support at the diagonal gasket is obtained.

13 Claims, 4 Drawing Sheets

(56) References Cited

U.S. PATENT DOCUMENTS

| | | | | | |
|---|---|---|---|---|---|
| 3,179,165 | A | * | 4/1965 | Usher et al. | 165/167 |
| 3,532,161 | A | * | 10/1970 | Loebel | 165/167 |
| 3,792,730 | A | | 2/1974 | Andersson | |
| 4,403,652 | A | | 9/1983 | Schiltz et al. | |
| 4,635,714 | A | * | 1/1987 | Almqvist et al. | 165/167 |
| 4,781,248 | A | | 11/1988 | Pfeiffer | |
| 5,307,869 | A | * | 5/1994 | Blomgren | 165/167 |
| 5,470,431 | A | | 11/1995 | Okuda et al. | |
| 6,073,687 | A | * | 6/2000 | Jensen et al. | 165/167 |
| 7,424,908 | B2 | * | 9/2008 | Blomgren | 165/167 |

FOREIGN PATENT DOCUMENTS

| | | | |
|---|---|---|---|
| EP | 1 722 184 | | 11/2006 |
| GB | 1 288 887 | | 9/1972 |
| GB | 2 128 726 | | 5/1984 |
| JP | 51-20744 | | 6/1976 |
| JP | 62-198384 | | 12/1987 |
| JP | 02-127987 | | 10/1990 |
| JP | H06-39259 | Y2 | 10/1994 |
| JP | 08-271172 | | 10/1996 |
| JP | 11-101583 | | 4/1999 |
| JP | 2001-41678 | | 2/2001 |
| JP | 2001-272194 | | 10/2001 |
| RU | 2 165 570 | | 11/1999 |
| SE | 165 960 | | 1/1959 |
| SE | 508 384 | | 9/1998 |
| UA | 9 612 | U | 10/2005 |
| WO | 2005/045346 | | 5/2005 |
| WO | 2006/080874 | | 8/2006 |

OTHER PUBLICATIONS

Office Action (Rejection Notice) for Japanese Patent Application No. 2010-538722 dated Dec. 11, 2012 with English translation.

* cited by examiner

HEAT EXCHANGER

TECHNICAL FIELD

The present invention relates to a gasket support in a plate heat exchanger having a contact-free distribution channel. The invention further relates to a heat exchanger comprising a plurality of heat exchanger cassettes having a gasket support.

BACKGROUND ART

Food manufacture is typically characterised by the need to process and treat highly viscous products, e.g. concentrates for carbonated beverages, juices, soups, dairy products and other products of fluid consistency. For natural reasons, the hygiene aspirations and expectations in this context are extremely high to enable the requirements of various authorities to be met. Highly viscous fluids containing particles or fibres are also used in other areas of the industry, e.g. in different processing industries.

Plate heat exchangers are used in the industry for a number of different purposes. One problem in using plate heat exchangers for e.g. the food industry is that some products contain fibres and other solid materials mixed in the fluid. In most plate heat exchangers, the heat exchanger comprises one type of plate, which is mounted with every other plate rotated 180 degrees to form two different channels for the fluids, one channel for the cooling medium and one channel for the product that is to be cooled. Between each plate is a sealing provided. Such an arrangement is cost-effective and works for many applications, but shows some drawbacks when it comes to beverages and other products that comprises fibres and other solid materials, since the plates will bear on each other at some contact points. Each plate is provided with ridges and valleys in order to on one hand provide a mechanical stiffness and on the other hand to improve the heat exchange to the liquid. The plates will bear on each other where the patterns of the plates meet each other, which will improve the mechanical stiffness of the plate package. This is important especially when the fluids have different pressures. A drawback of the plates bearing on each other is that each bearing point will constitute a flow restriction where material contained in the liquid may be trapped and can accumulate. The accumulated material will restrict the flow further, causing more material to accumulate. This will somewhat resemble the formation of a river delta, where a small flow difference will deposit some material which in turn causes more material to deposit.

One solution to the problem with clogging of material in a plate heat exchanger is to use a heat exchanger where the product channel is contact-free. This type of heat exchanger reduces the accumulation of material in the product channel. It is however important that also the areas close to the sealing gasket are designed not to accumulate material and that they at the same time are mechanically rigid. One such specific area is the area around the so-called diagonal gasket.

U.S. Pat. No. 4,781,248 A describes a heat exchanger with a waffle-like grid structure pattern in the zones between the inlet and outlet regions and the heat transfer area. The waffle-like pattern is used to improve the flow distribution in the heat exchanger.

U.S. Pat. No. 4,403,652 describe a heat exchanger with a contact-free channel. The heat exchanger comprises specific, extruded heat panels having two sides connected by webs and specific header sections made by casting. Since the header sections are cast, the area around the gaskets can be designed without weak spots. This solution is rather expensive and complicated, but may work for some applications.

In order to obtain a sufficient rigidity when using traditionally heat exchanger plates for a contact-free plate heat exchanger, the plates are permanently joined together in pairs, e.g. by welding or brazing. In this way, two plates form a cassette with a plurality of contact points between the plates, where the contact points are joined together as well as the rim of the plate. The cassette will be rigid enough to handle some differences in pressure between the two fluids, thereby enabling the contact-free product channel. One plate heat exchanger having a contact-free channel is known from JP 2001272194. In this heat exchanger, two plates of the same type having longitudinal grooves are permanently connected to each other to form a cassette, in which longitudinal channels are formed for the heat exchange fluid. Such cassettes are stacked using gaskets, thereby forming a contact-free product channel between two cassettes.

Another heat exchanger having a contact-free product channel is disclosed in WO 2006/080874. In the disclosed heat exchanger, a corrugated and undulating pattern perpendicular to the flow direction is used in order to provide rigidity to the plates and also to improve the heat transfer between the two fluids. Since the area around the diagonal gasket groove is angled in relation to the pattern of the heat exchanger plates, the ridges and valleys will be asymmetric at the gasket groove. Due to this asymmetry, the distance between the support points in the diagonal gasket groove will be irregular, which will create weak regions, having a nonuniform mechanical stiffness, in the gasket groove. The weak regions, i.e. where the distance between the support points are large, may not be able to support the gasket sufficiently which may cause the gasket to be forced out of the groove when the pressure exceeds a specific value. This may cause a leakage in the product passage and may also cause substantial deformations of the heat exchanger plates.

The heat exchanger disclosed in WO 2006/080874 is a so-called semiwelded plate heat exchanger, i.e. a heat exchanger comprising a number of cassettes formed by welding or brazing heat exchanger plates together in pairs. The weld seam normally runs along the side edges of the cassettes and around the portholes. A gasket is disposed between the respective cassettes and is normally made of a rubber material and situated in a groove of the heat exchanger plate. One fluid flows inside the cassettes, and another fluid between the cassettes. The flow channel inside the cassettes is used for the heating/cooling fluid and the flow channel between the cassettes is used for the fibrous fluid. Semiwelded plate heat exchangers tolerate relatively high pressures and make it possible to open the plate package and clean the spaces between pairs of welded heat exchanger plates. The welds which replace the gaskets in every second space between plates round the heat transfer surface of the heat exchanger plates reduce the need for gasket replacement and enhance safety.

These solutions may function for some applications, but they still show some disadvantages. There is thus room for improvements.

DISCLOSURE OF INVENTION

An object of the invention is therefore to provide an improved diagonal gasket support for a plate heat exchanger having a contact-free flow channel.

With a diagonal gasket support in a heat exchanger cassette adapted for a heat exchanger having a contact-free flow channel, where the cassette comprises two plates of the same type, where each plate is provided with a corrugated pattern having a plurality of ridges and valleys, the object of the invention is achieved in that the diagonal gasket support comprises a plurality of indentations and protrusions positioned adjacent each other along a diagonal gasket groove.

By this first embodiment of the diagonal gasket support, a gasket support is obtained which allows for a mechanically stiff support of the sealing gasket and at the same time allows for a contact-free product channel in the region close to the diagonal sealing gasket. This will allow for a reliable sealing around the complete cassette.

In an advantageous development of the inventive diagonal gasket support, the indentations of the two plates bear on each other. This allows for a rigid and thus stiff diagonal gasket groove.

In an advantageous development of the inventive diagonal gasket support, the indentations of the two plates are permanently joined to each other. This allows for a rigid and stiff diagonal gasket groove that can handle a high pressure in both directions, i.e. overpressure and negative pressure in the product channel.

In another advantageous development of the inventive diagonal gasket support, the diagonal gasket support is positioned between the diagonal gasket groove and the heat transfer surface. The advantage of this is that the support is obtained in the heating/cooling medium channel without disturbing the contact-free product channel. This will also improve the support of the diagonal sealing gasket.

In an advantageous further development of the inventive diagonal gasket support, the diagonal gasket support comprises a by-pass channel. This is advantageous in that it improves the flow properties of the fluid, since the fluid can flow in the by-pass channel without being disturbed by the support points.

In an advantageous further development of the inventive diagonal gasket support, the indentations and protrusions are rectangular. This gives a good rigidity of the sealing groove and a large contact area for the support points.

In an advantageous further development of the inventive diagonal gasket support, the indentations and protrusions are circular. This will also give a good rigidity of the sealing groove and a large contact area for the support points.

In an inventive heat exchanger, a plurality of heat exchanger cassettes having a diagonal gasket support is comprised. This allows for an improved heat exchanger with an improved reliability that can withstand higher pressure differences between the two channels.

In an advantageous further development of the inventive heat exchanger, the shortest distance between two diagonal gasket supports in the contact-free channel between two cassettes is at least the same as the shortest distance between the heat transfer surfaces of the two cassettes. The advantage of this is that the flow properties are improved, since there will not be any regions at the diagonal gasket support that will restrict the flow adversely.

In an advantageous further development of the inventive heat exchanger, the heat exchanger comprises one type of cassettes. The advantage of this is that the heat exchanger is cost-effective to produce.

In an advantageous further development of the inventive heat exchanger, the shortest distance between two diagonal gasket supports in the contact-free channel between two cassettes is the distance a between two protrusions. When the heat exchanger uses one type of cassettes, the protrusions of the adjacent cassettes will line up next to each other. For this type of heat exchanger, it is important that this distance does not restrict the flow adversely, causing clogging of material contained in the fluid.

In an advantageous further development of the inventive heat exchanger, the heat exchanger comprises two different types of cassettes. The advantage of this is that the flow pattern of the cassettes and thus the performance of the heat exchanger can be optimised.

In an advantageous further development of the inventive heat exchanger, the shortest distance between two diagonal gasket supports in the contact-free channel between two cassettes is the distance b between the side walls of two protrusions. When the heat exchanger uses two different types of cassettes, a protrusion of one cassette will line up with an indentation of the next cassette. For this type of heat exchanger, it is important that this distance does not restrict the flow adversely, causing clogging of material contained in the fluid.

In an advantageous further development of the inventive heat exchanger, the heat exchanger cassettes are coated with a surface coating. The advantage of this is that since the cassettes of two adjacent cassettes in the heat exchanger do not touch each other in the contact-free channel, there are no points in the contact-free channel subjected to wear. It is therefore possible to coat the surfaces of the contact-free channels, without the risk that the coating will wear. Since the coating will not wear, the maintenance is largely reduced and a reliable coating is obtained.

In an advantageous further development of the inventive heat exchanger, the surface coating is applied on the surface surrounded by the sealing gasket. This is advantageous in that only the active surface of the contact-free channel is coated, which reduces the amount of coating material and thus the cost for the coating.

BRIEF DESCRIPTION OF DRAWINGS

The invention will be described in greater detail in the following, with reference to the embodiments that are shown in the attached drawings, in which.

MODES FOR CARRYING OUT THE INVENTION

The embodiments of the invention with further developments described in the following are to be regarded only as examples and are in no way to limit the scope of the protection provided by the patent claims.

Figure 1:
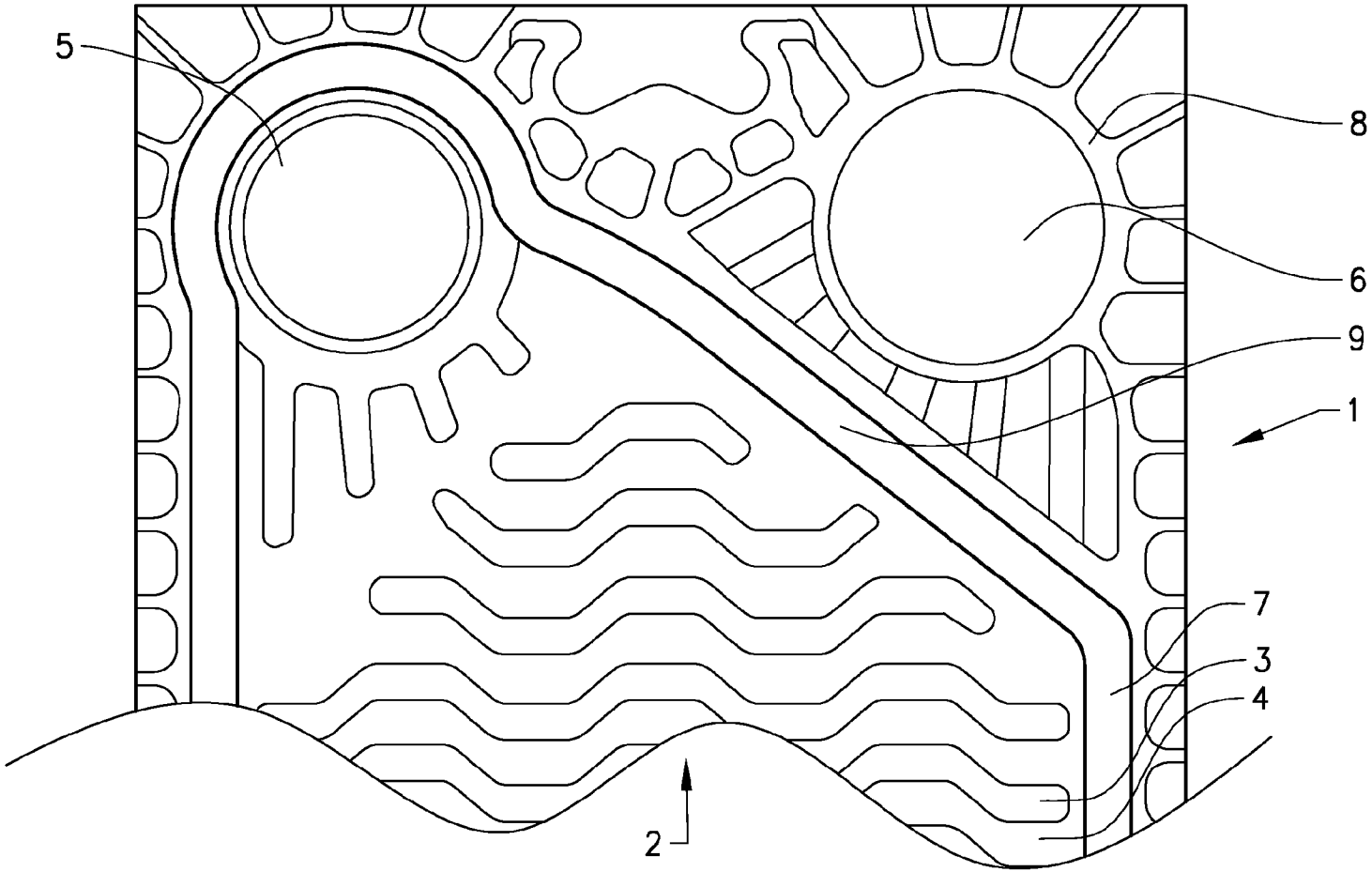
FIG. 1 PRIOR ART
FIG. 1 shows a prior art diagonal gasket support in a plate heat exchanger having a contact-free flow channel.

FIG. 1 shows part of a prior art contact-free cassette for a heat exchanger as disclosed in WO 2006/080874. The heat exchanger cassette 1 comprises two portholes constituting inlet and outlet ports 5, 6 and a heat transfer surface 2 with ridges 3 and valleys 4. The plate further comprises sealing gaskets adapted to seal off fluid channels in the heat exchanger. A gasket 7 seals off the contact-free product flow channel and a ring gasket 8 seals off the port for the cooling/heating fluid. Gasket 7 comprises a diagonal gasket section 9 that defines the border for the product channel at the distribution areas at the inlet and outlet ports. The diagonal gasket section 9 is placed in a diagonal gasket groove. Since the diagonal gasket groove is angled relatively the length axis of the cassette, and the heat exchange pattern comprises angled sections as well, the pattern next to the diagonal gasket groove will be asymmetric, having ridges and valleys with different widths. Since the pattern next to the diagonal gasket groove constitutes the diagonal gasket support in the cassette when the cassette is assembled, the diagonal gasket support will have different mechanical properties along its length. The diagonal gasket groove itself does not bear on the other plate in the cassette, which means that the diagonal gasket is supported only by the pattern next to the diagonal gasket groove. Since the cassette is to be used in a heat exchanger having a contact-free product channel, the pattern next to the diagonal gasket groove can not bear on an adjacent plate of another cassette. The stiffness of the diagonal gasket support is thus determined by the pattern next to the diagonal gasket groove. The maximum allowed pressure at the diagonal gasket is thus limited due to the varying stiffness of the diagonal gasket groove along its length.

A cassette is made from two plates of the same type. One plate is rotated by 180° around a horizontal centre axis before the plates are joined. In this way, the pattern will interact such that the pattern of one plate will bear on the pattern of the other plate, creating a plurality of intermediate contact points. When all or at least some of these contact points are joined together, a stiff cassette that will withstand a certain overpressure within the cassettes as well as between the cassettes is obtained.

Figure 2:
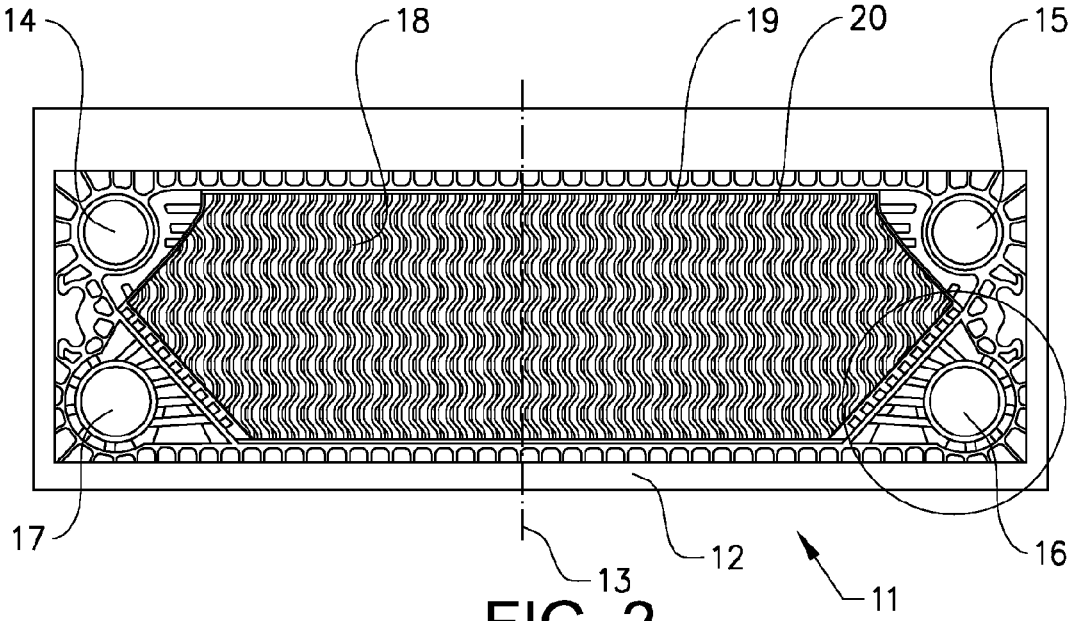
FIG. 2 shows a front view of a plate for the use in a heat exchanger comprising a diagonal gasket support according to the invention.

FIG. 2 shows a front view of a cassette 11 according to the invention for the use in a heat exchanger having a contact-free flow channel. The cassette 11 comprises two heat exchanger plates 12 permanently joined together. The plates have at least four portholes constituting inlet and outlet ports 14, 15, 16, 17 and a heat transfer surface 18 with ridges 19 and valleys 20. The cassette 11 may be produced e.g. by welding, brazing or gluing the plates together, whereby the two plates 12 are joined together permanently in a known manner such that a flow channel is created inside the cassette, Preferably, the plates are joined also in the heat transfer surface, where the pattern of one plate will bear on the pattern of the other plate. This is of advantage since the cassettes will be used in a heat exchanger having a contact-free flow channel. The support of the heat transfer surface will thus come only from the other plate in the cassette. The plates may e.g. be joined along a few longitudinal lines reaching from one inlet/outlet side to the other inlet/outlet side. The cassette further comprises a diagonal gasket groove 21 in which a sealing gasket is mounted when the cassettes are assembled to form the heat exchanger.

Figure 3:
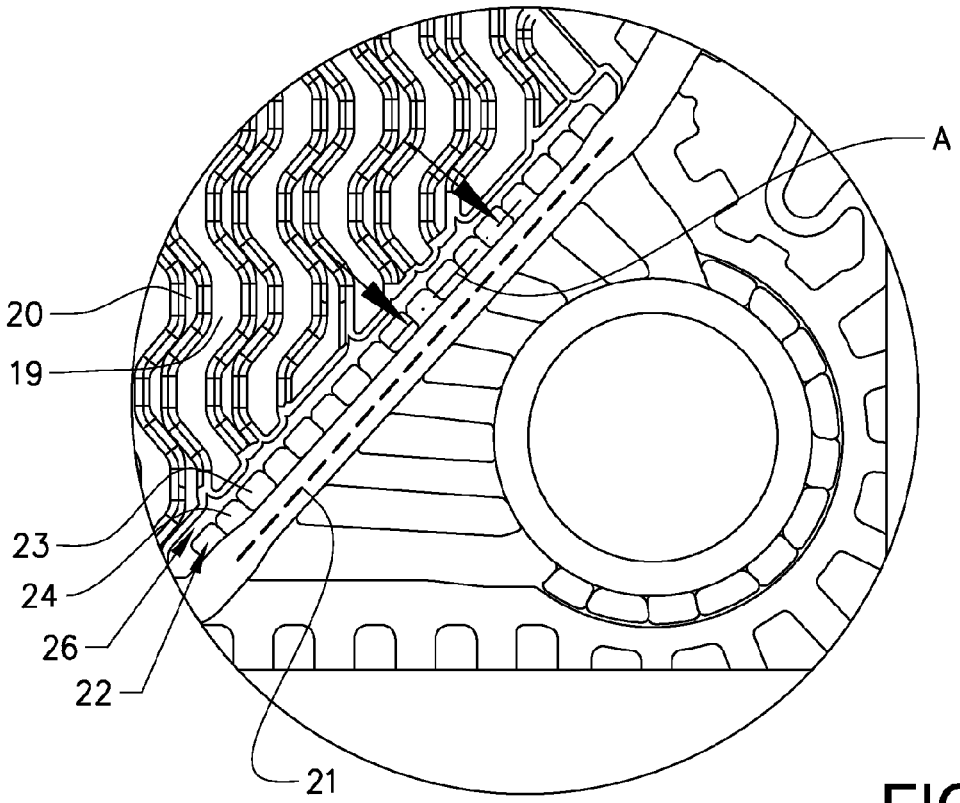
FIG. 3 shows a detail of a first embodiment of a diagonal gasket support according to the invention.

FIG. 3 shows a detail of the area around the diagonal gasket groove 21. The cassette further comprises an inventive diagonal gasket support 22 having a plurality of indentations 23 and protrusions 24, positioned adjacent each other along the main part of the diagonal gasket groove 21. The indentations and protrusions are in this example rectangular, but they may also have other shapes, such as circular or semi-circular shapes. The diagonal gasket groove 21 is positioned directly adjacent the diagonal gasket groove 21 such that the sealing gasket will bear on the sides of the protrusions 24 when the cassette is mounted in a heat exchanger. The diagonal gasket support 22 is positioned between the diagonal gasket groove 21 and the heat transfer surface 18. When two plates are assembled into a cassette, the indentations and protrusions will form contact points on which the two plates will bear. At least some of these contact points are preferably joined together, e.g. by using the same method as the one used to assemble the cassette.

Figure 4:
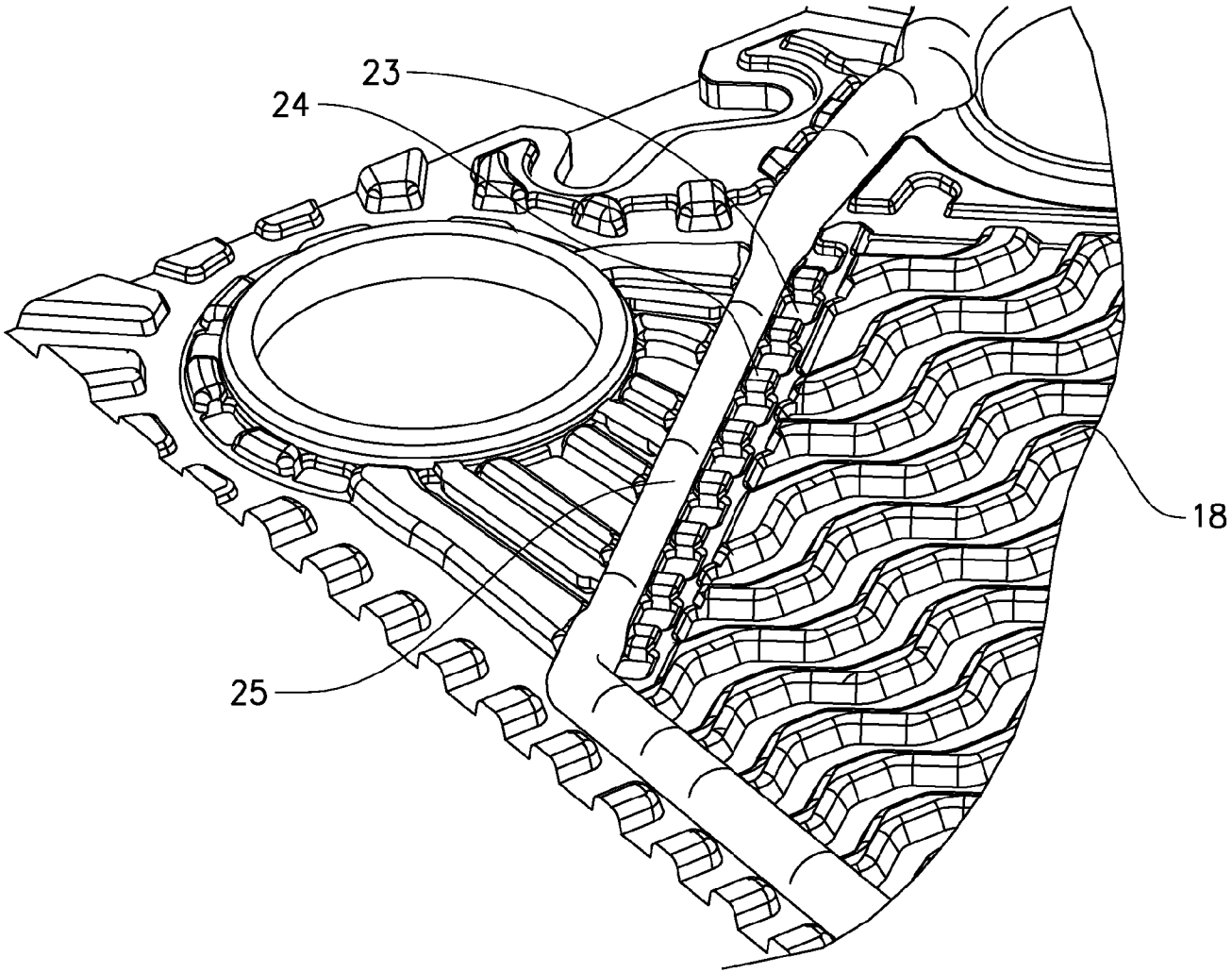
FIG. 4 shows a view of a sealing gasket and a diagonal gasket support according to the invention.

FIG. 4 shows a view of the diagonal gasket support area with a diagonal gasket section 25. Between the pattern of the heat transfer surface of the heat exchanger plate and the diagonal gasket support is a narrow by-pass channel 26 created. The by-pass channel will help the distribution of fluid to the entire heat transfer surface.

In a first embodiment, the heat exchanger comprises one cassette type 11 made from two plates of the same type. One plate is rotated by 180° around a centre axis before the plates are joined. In this way, the pattern will interact such that the pattern of one plate will bear on the pattern of the other plate, creating a plurality of intermediate contact points inside the cassette. When all or at least some of these contact points are permanently joined together, a stiff cassette that will withstand a certain overpressure is obtained. Since one of the plates in a cassette is turned over, the diagonal gasket support 22 will comprise areas where two indentations 23 are joined together and areas where two protrusions 24 form a hollow space.

Figure 5:
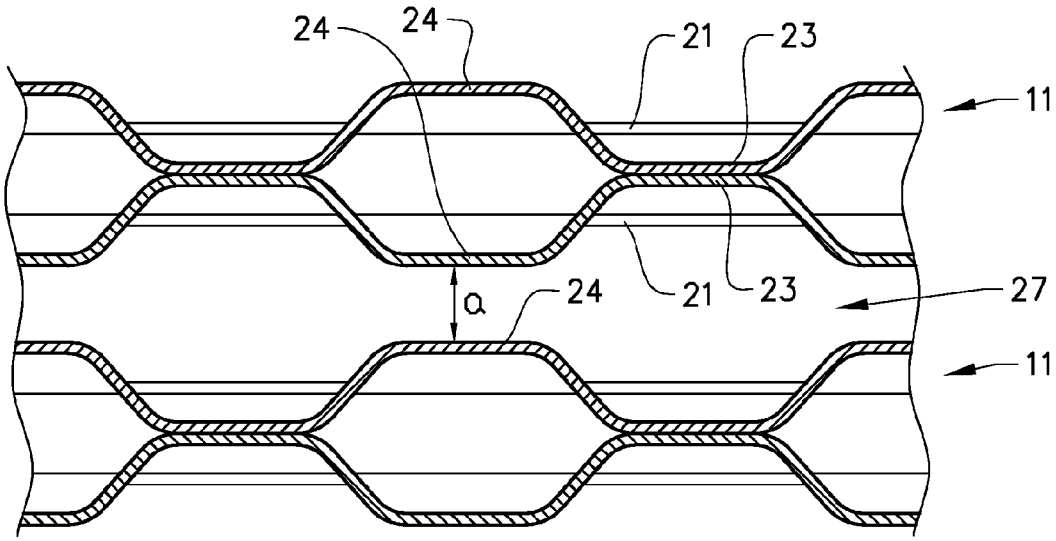
FIG. 5 shows cross-section A-A of the gasket support when used in a first type of heat exchanger cassette.

When the same type of cassette is stacked to form a heat exchanger, the contact-free channel 27 will have a cross-section A-A as is seen in FIG. 5. In this embodiment, a protrusion 24 of the first cassette will be adjacent a protrusion 24 of the second cassette. In the same way, an indentations 23 of the first cassette will be adjacent an indentation 23 of the second cassette. In this embodiment, the volume between the protrusions 24 will restrict the flow of the fluid. The distance a between the protrusions will decide the magnitude of the flow restriction. Preferably, the distance between the protrusions is the same or larger than the smallest distance between any surfaces in the contact-free flow channel. In this way, an even flow without flow restriction points is obtained, such that there is no point where material will start to accumulate in the contact-free flow channel. The height of the protrusions is thus adapted to the dimensions of the sealing gasket and the pattern of the heat exchanger plates.

In a second embodiment, the heat exchanger comprises a first cassette type 11 made from two heat exchanger plates of a first type and a second cassette type 29 made from two plates of a second type. In a cassette, one plate is rotated by 180° around a centre axis before the plates are joined to form a cassette. In this way, the pattern will interact such that the pattern of one plate will bear on the pattern of the other plate, creating a plurality of intermediate contact points inside the cassette. When all or at least some of these contact points are permanently joined together, a stiff cassette that will withstand a certain overpressure is obtained. Since one of the plates in a cassette is turned over, the diagonal gasket support will comprise areas where two indentations 23 are joined together and areas where two protrusions 24 form a hollow space. The plates for the second cassette have the same pattern as the plates for the first cassette, but with the pattern rotated or offset compared with the plates for the first cassette.

Figure 6:
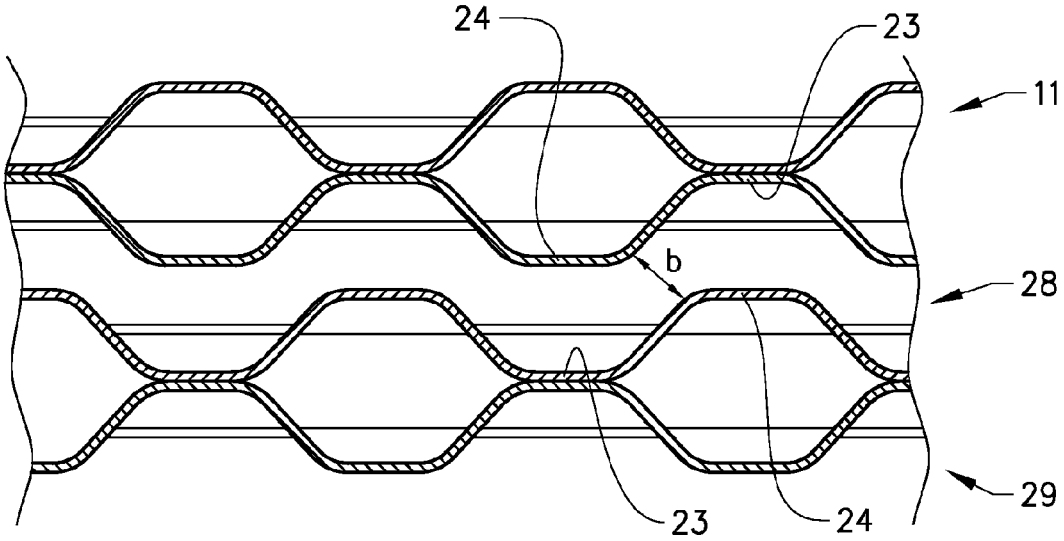
FIG. 6 shows cross-section A-A of the gasket support when used in a second type of heat exchanger cassette.

When the first and the second types of cassettes are stacked to form a heat exchanger, the contact-free channel 28 will have a cross-section A-A as is seen in FIG. 6. In this embodiment, a protrusion 24 of the first cassette will be adjacent an indentations 23 of the second cassette. In the same way, an indentations 23 of the first cassette will be adjacent a protrusion 24 of the second cassette. In this embodiment, the volume between the side walls of the protrusions will restrict the flow of the fluid. The distance b between the side walls of the protrusions will decide the magnitude of the flow restriction. Preferably, the distance between the side walls of the protrusions is the same or larger than the smallest distance between any surfaces in the contact-free flow channel. In this way, an even flow without flow restriction points is obtained, such that there is no point where material will start to accumulate in the contact-free flow channel. The shape of the protrusions is thus adapted to the dimensions of the sealing gasket and the pattern of the heat exchanger plates.

The patterns of the first and second cassettes are configured in such a way that there will be no contact points between the cassettes at the heat transfer surface, i.e. inside of the sealing gasket in the contact-free flow channel, when the cassettes are assembled in a heat exchanger. The cassettes are mounted to each other with a sealing gasket. The gasket, which is preferably made of an elastic material, e.g. rubber material, is disposed in a groove which extends along the periphery of the constituent plates of the cassette. The purpose of the gasket is to seal the space between two cassettes, thereby defining a contact-free flow channel, which is the product flow channel. The heat exchanger plates are so designed that contact points for necessary mechanical support occur only on the inside of a cassette, between two plates which are to be joined together to form a cassette, or outside of the sealing gasket.

One advantage of having a contact-free product flow channel, in which there is no contact points between the cassettes, is that the heat transfer surface can be coated with a specific coating. In present contact-free heat exchangers, the central heat transfer surface is without contact points, but there are some contact points in the product channel at the inlet port and outlet port.

If a surface treatment is made on a surface of a known contact-free plate heat exchanger, the coating will eventually wear off or be damaged due to mechanical abrasion between the contact points. When e.g. a corrosion protecting coating is damaged at a cassette, the coating of the complete cassette will be useless since corrosion will start at the damaged spots and the cassette must thus be changed. By using cassettes comprising the inventive diagonal gasket support, heat exchangers without any contact points inside the product flow channel can be provided. Such heat exchangers cassettes can thus be coated with different surface coatings that will not wear off because of abrasion between contact points between the cassettes. By using different surface coatings, the product channel can be optimised for different purposes. One example of a surface coating is a friction coating to raise or lower the surface friction. Another example is a surface coating to raise or lower the surface finish or a corrosion inhibitor coating to raise the corrosion resistance of the material used for the cassettes. Yet another example of a surface coating is a coating to lower the risk of a specific substance to stick to the surface. Surface coatings of other types are also possible when using cassettes with the inventive diagonal gasket support.

The invention is not to be regarded as being limited to the embodiments described above, a number of additional variants and modifications being possible within the scope of the subsequent patent claims. In one example, a different gasket support pattern may be used for the heat exchanger cassettes.

REFERENCE SIGNS

Prior Art

1: Cassette
2: Heat transfer surface
3: Ridge
4: Valley
5: Port
6: Port
7: Gasket
8: Ring gasket
9: Diagonal gasket section
11: Cassette
12: Plate
13: Centre axis
14: Port
15: Port
16: Port
17: Port
18: Heat transfer surface
19: Ridge
20: Valley
21: Diagonal gasket groove
22: Diagonal gasket support
23: Indentations
24: Protrusions
25: Diagonal gasket section
26: By-pass channel
27: Contact-free channel
28: Contact-free channel
29: Second cassette

The invention claimed is:

1. A diagonal gasket support in a heat exchanger cassette adapted for a heat exchanger, wherein the cassette comprises two plates of a same type, wherein each plate has a heat transfer surface and is provided with a corrugated pattern having a plurality of ridges and valleys whereby respective heat transfer surfaces of adjacent cassettes in the heat exchanger define a flow channel of the heat exchanger in which the respective heat transfer surfaces are not in contact with each other, the diagonal gasket support comprises a plurality of indentations and protrusions positioned adjacent each other along a diagonal gasket groove which at least partially bounds the flow channel of the heat exchanger, the indentations of the two plates removably bear on each other or are permanently joined to each other, and the diagonal gasket support further comprises a by-pass channel positioned between the indentations and protrusions of the diagonal gasket support and the heat transfer surface, said bypass channel being narrower than the indentations and protrusions.

2. The diagonal gasket support according to claim 1, wherein the indentations of the two plates removably bear on each other.

3. The diagonal gasket support according to claim 1, wherein the indentations of the two plates are permanently joined to each other.

4. The diagonal gasket support according to claim 1, wherein the indentations and protrusions are rectangular.

5. The diagonal gasket support according to claim 1, wherein the indentations and protrusions are circular.

6. A heat exchanger comprising a plurality of heat exchanger cassettes having a diagonal gasket support according to any of claims 1 and 2.

7. The heat exchanger according to claim 6, wherein the heat exchanger cassettes comprise a surface coating.

8. The heat exchanger according to claim 7, wherein the surface coating is on the surface surrounded by a sealing gasket.

9. A heat exchanger comprising a plurality of heat exchanger cassettes having a diagonal gasket support, wherein each cassette comprises two plates of a same type, wherein each plate has a heat transfer surface and is provided with a corrugated pattern having a plurality of ridges and valleys whereby respective heat transfer surfaces of adjacent cassettes in the heat exchanger define a flow channel of the heat exchanger in which the respective heat transfer surfaces are not in contact with each other, the diagonal gasket support comprises a plurality of indentations and protrusions positioned adjacent each other along a diagonal gasket groove which at least partially bounds the flow channel of the heat exchanger, the indentations of the two plates removably bear on each other or are permanently joined to each other, the diagonal gasket support further comprises a by-pass channel positioned between the indentations and protrusions of the diagonal gasket support and the heat transfer surface, and wherein the shortest distance between two diagonal gasket supports in the flow channel between two cassettes is at least the same as the shortest distance between the heat transfer surfaces of the two cassettes in the flow channel.

10. The heat exchanger according to claim 9, wherein the heat exchanger comprises one type of cassette.

11. The heat exchanger according to claim 10, wherein the shortest distance between two diagonal gasket supports in the flow channel between two cassettes is the distance between two protrusions.

12. The heat exchanger according to claim 9, wherein the heat exchanger comprises two different types of cassettes.

13. The heat exchanger according to claim 12, wherein the shortest distance between two diagonal gasket supports in the flow channel between two cassettes is the distance between the side walls of two protrusions.

* * * * *